US005896613A

United States Patent [19]

Courtney et al.

[11] Patent Number: 5,896,613

[45] Date of Patent: Apr. 27, 1999

[54] FLOOR MOP WITH SCRUB STRIP

[75] Inventors: Steve P. Courtney, Troy; Robert F. Leventhal, Dayton; Paul R. Burger, Lebanon, all of Ohio

[73] Assignee: O-Cedar Brands, Inc., Springfield, Ohio

[21] Appl. No.: 08/901,401

[22] Filed: Jul. 28, 1997

[51] Int. Cl.[6] ..... A47L 13/146

[52] U.S. Cl. ..... 15/119.2; 15/118

[58] Field of Search ..... 15/118, 119.1, 15/119.2, 116.2, 116.1

[56] References Cited

U.S. PATENT DOCUMENTS 2,896,235 7/1959 Clements .
4,491,998 1/1985 Wilson et al. .
4,604,767 8/1986 Burkhart et al. .
4,864,675 9/1989 Jones .
5,483,720 1/1996 Decoopman et al. .
5,488,750 2/1996 Vosbikian et al. .

*Primary Examiner*—Randall E. Chin
*Attorney, Agent, or Firm*—Biebel & French

[57] ABSTRACT

A butterfly mop including a scrub strip which is mounted to an actuation yoke for the mop. The scrub strip is formed as a clip-on structure mounted to the actuation yoke adjacent to an end of the yoke. The scrub strip is movable from a non-use position to an operable position when the actuation yoke is actuated to wring the mop. In addition, a mechanism is provided for locking the scrub strip in its operable position to facilitate use of the scrub strip.

16 Claims, 5 Drawing Sheets

FLOOR MOP WITH SCRUB STRIP

BACKGROUND OF THE INVENTION

The present invention generally relates to a butterfly mop and, more particularly, to a butterfly mop including a clip-on scrub strip.

Butterfly mops are well known and generally include a mop handle supporting a mop head including two flapper or presser plates. The presser plates support a mop pad, such as a sponge, and are mounted for pivotal movement downwardly and toward each other in order to wring fluids from the mop pad. In a typical construction, a yoke actuator is supported adjacent a rearward portion of the presser plates and includes portions for engaging and causing the downward movement of the plates. Such prior art butterfly mop structures are illustrated in U.S. Pat. No. 4,864,675 issued to Jones and U.S. Pat. No. 5,488,750 issued to Vosbikian et al.

In addition, the patent to Vosbikian shows that a scrub strip may be attached to a sponge support member for a mop in order to provide an abrasive material for facilitating cleaning of the floor. Further, it is also known to provide mop pads for mops with scrub strips mounted directly to the edge of the pads wherein the edge of the pad carrying the scrub strip may be directed to the floor surface for a scrubbing operation. Thus, prior art butterfly mops generally required that an appropriate scrub strip be carried by the mop pad and/or that the mop be rotated or otherwise reoriented to use the scrub strip.

Accordingly, there is a need for a scrub strip for use with butterfly mops which avoids the necessity of manipulating the handle, such as by rotating it, to orient the scrub strip toward the floor surface. There is a further need for a butterfly mop incorporating a scrub strip wherein the scrub strip may be positioned out of the way when the scrub strip is not in use, and which conveniently positions the scrub strip adjacent to a floor surface for a scrubbing operation.

SUMMARY OF THE INVENTION

In accordance with the present invention, a mop is provided including an elongated mop handle, a slide grip handle slidably received on the mop handle, an actuation yoke pivotable about a pivot axis, and a connecting link extending between the slide grip handle and the actuation yoke such that movement of the slide grip handle along the mop handle causes the actuation yoke to pivot about the pivot axis. In addition, two presser plates are mounted to respective pivot points adjacent an end of the mop handle wherein the presser plates support a mop pad such as a sponge.

A pair of squeeze arms defined by the actuation yoke engage and pivot the presser plates toward each other to a mop pad squeezing position when the slide grip handle is moved along the mop handle. A scrub strip is located adjacent the ends of the squeeze arms and are supported for movement with the actuation yoke between a non-use position and an operable position wherein movement of the scrub strip from the non-use position to the operable position coincides with the pivoting of the presser plates toward each other.

The scrub strip is configured to clip onto the actuation yoke and includes a base portion, a strip of floor scrubbing material attached to a first side of the base portion and a cover portion attached to a second side of the base portion. A passage is defined between the base portion and the cover portion for receiving the actuation yoke to thereby support the scrub strip on the mop.

The yoke and scrub strip are configured such that the scrub strip is positioned above the presser plates in its non-use position, and is located below the presser plates and mop pad in its operable position to engage with a floor surface.

Therefore, it is an object of the present invention to provide a mop including a scrub strip movable between a non-use and an operable position.

It is a further object to provide such a mop wherein the mop includes a pair of presser plates actuated by a yoke member.

It is yet another object of the invention to provide a scrub strip attachable to the yoke of a butterfly mop.

Other objects and advantages of the invention will be apparent from the following description, the accompanying drawings and the appended claims.

DETAILED DESCRIPTION OF THE PREFERRED EMBODIMENT

Figure 1:
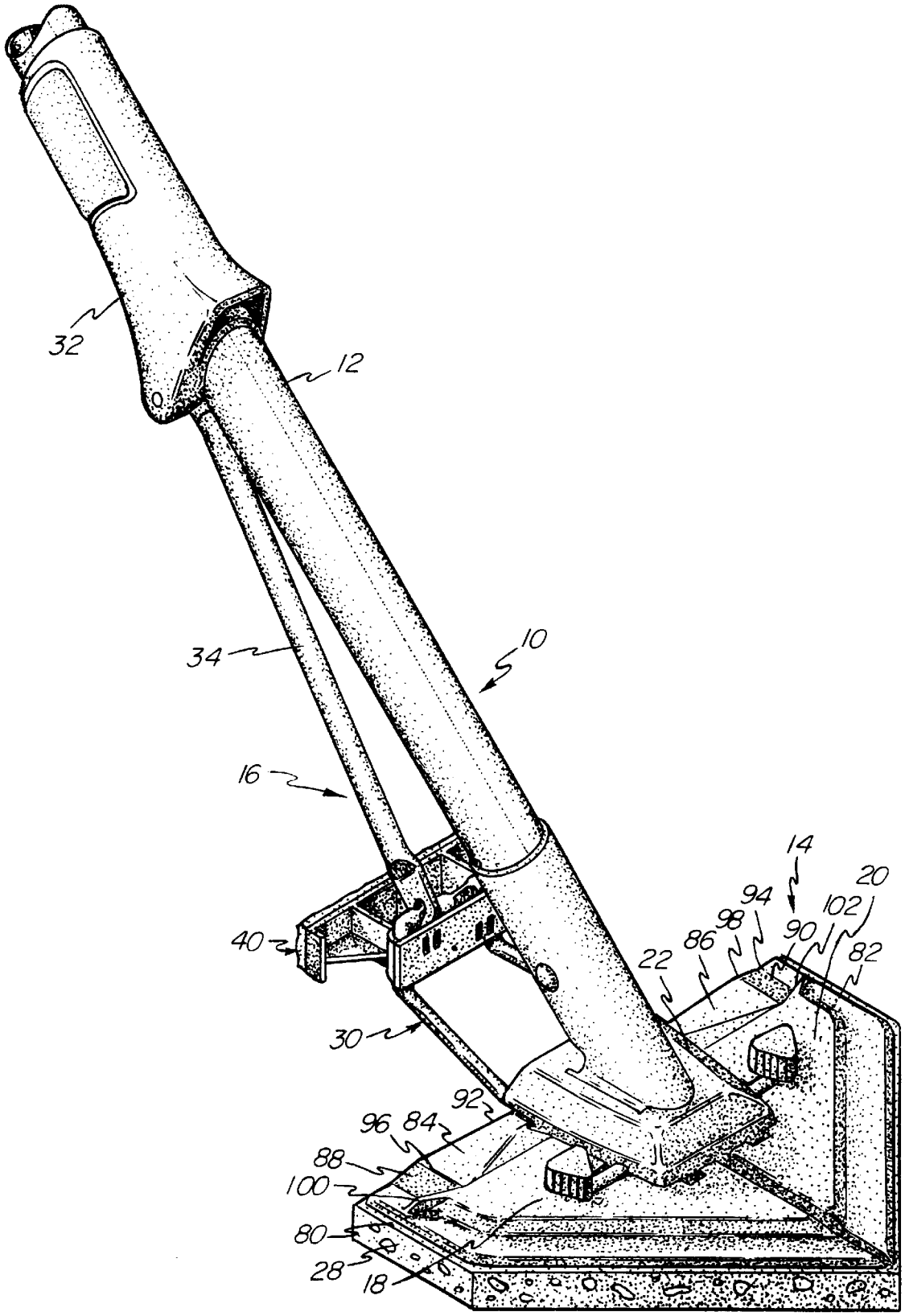
FIG. 1 is a perspective view of a butterfly mop incorporating a scrub strip in accordance with the present invention.

Referring to FIG. 1, there is shown a butterfly mop 10 constructed in accordance with the present invention. The mop 10 includes an elongated handle 12, a mop head 14 supported at a lower end of the handle 12 and an actuation member 16 for actuating the mop 10 in a wringing operation, as will be described more fully below.

Figure 5:
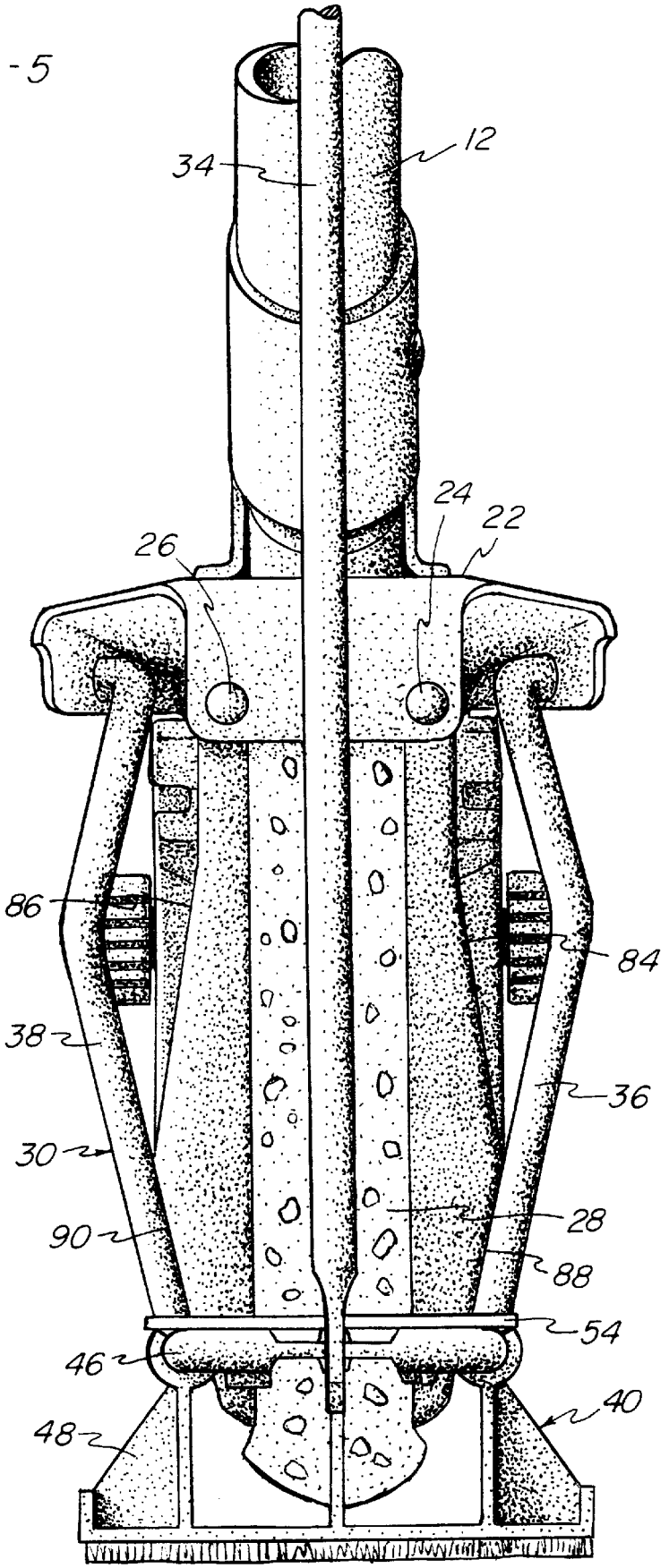
FIG. 5 is a rear elevational view showing the scrub strip in an operable position.

The mop head 14 is of a generally triangular configuration and includes first and second presser plates 18, 20 mounted to a mounting plate 22. The first and second presser plates 18, 20 are mounted for pivotal movement relative to the mounting plate 22 at respective pivot points defined by pins 24, 26 located adjacent to the lower end of the mop handle 12 (FIG. 5). The presser plates 18, 20 support a mop pad 28, such as a sponge mop.

Figures 2, 3:
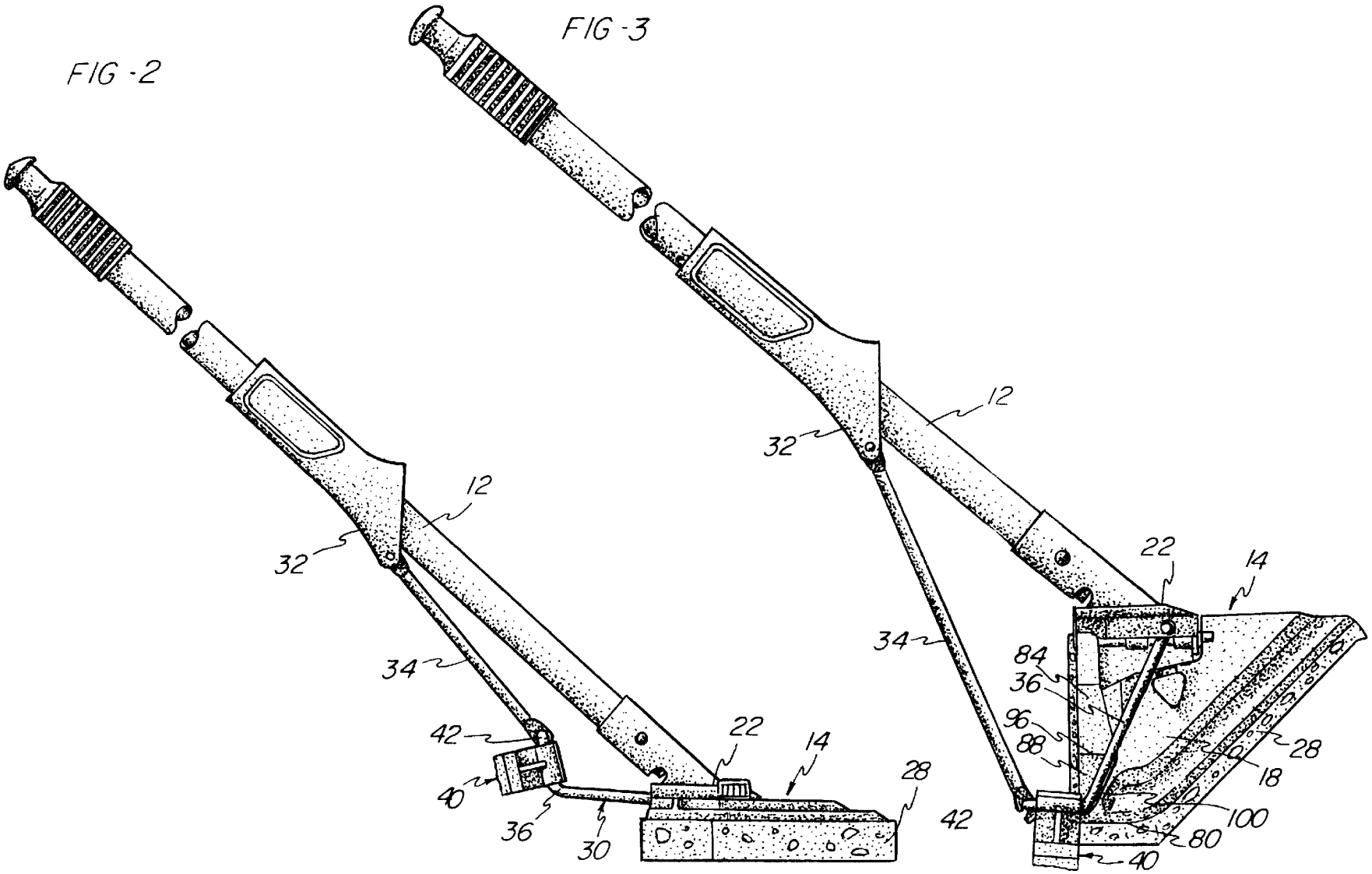
FIG. 2 is a side elevational view thereof showing the scrub strip in a non-use position.
FIG. 3 is a side elevational view showing the scrub strip in an operable position.

Referring further to FIGS. 2 and 3, the actuation member 16 comprises an actuation yoke 30, a slide grip handle 32 and a connecting link 34 extending between the actuation yoke 30 and slide grip handle 32. The slide grip handle 32 is mounted for sliding movement along the mop handle 12 and is adapted to cause the actuation yoke 30 to pivot about a pivot axis between the positions shown in FIGS. 2 and 3. The actuation yoke 30 includes a pair of squeeze arms 36, 38 for engaging upper surfaces of the presser plates 18, 20 when the slide grip 32 is moved downwardly along the mop handle 12.

A scrub strip 40 is attached to the actuation yoke 30 adjacent to rearward portions of the squeeze arms 36, 38. In particular, scrub strip mounting extensions 42, 44 (FIG. 6) extend from the ends of the squeeze arms 36, 38 at an angle directed toward the mop handle 12. A transverse portion 46 of the actuation yoke extends between the extensions 42, 44 for connecting to the connecting link 34, and the scrub strip 40 is positioned below the transverse portion 46 facing in a rearward direction.

Figure 6:
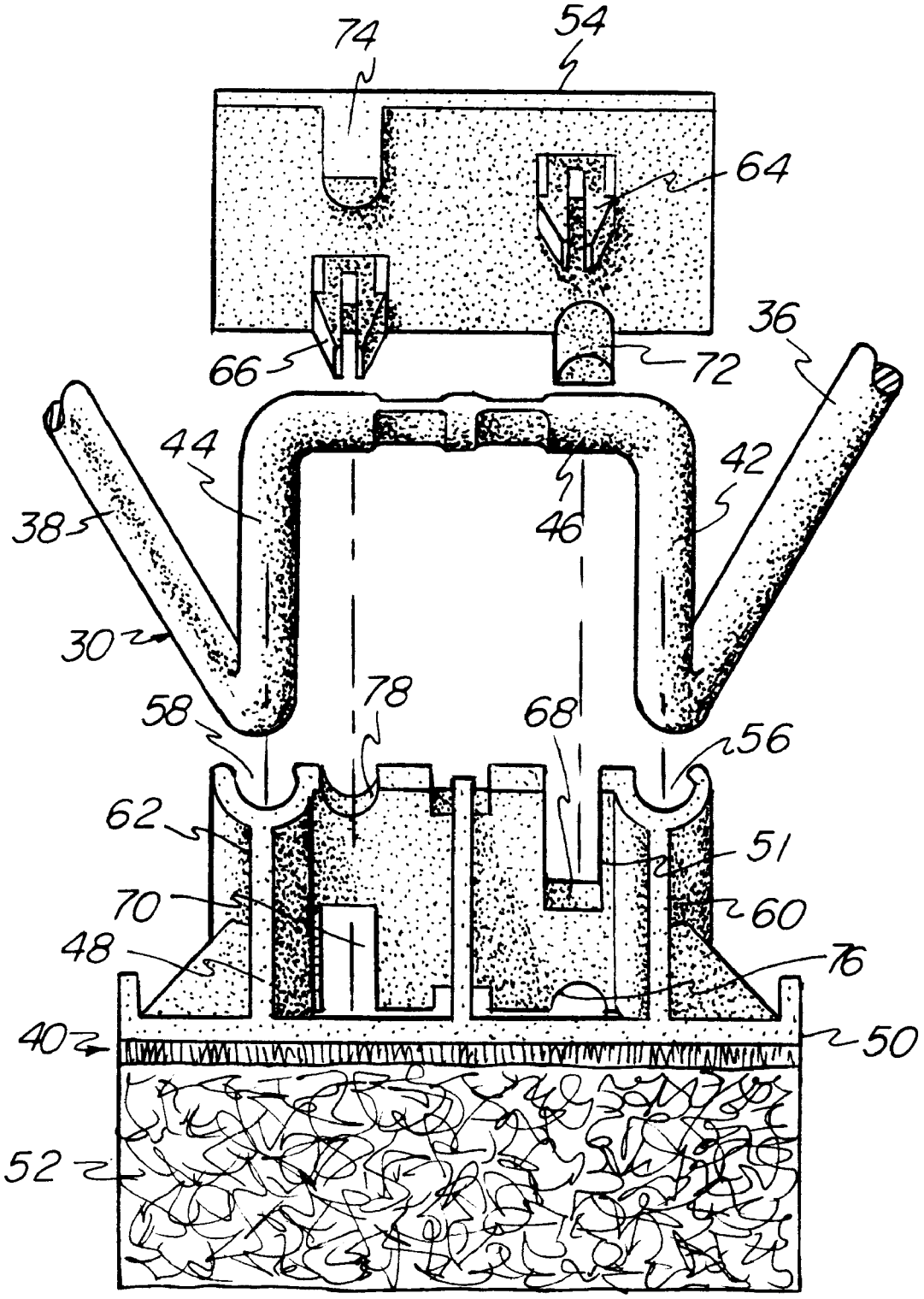
FIG. 6 is an exploded perspective view of the scrub strip.

Referring to FIG. 6, the scrub strip 40 comprises a base portion 48 having a first side 50 and a second side 51. In addition, the scrub strip 40 includes a strip of floor scrubbing material 52, such as an abrasive fiber material, and a cover portion 54 which is adapted to be attached to the base portion 48.

A passage is defined between the base portion and the cover portion by a pair of arcuate aperture areas 56, 58 located on opposing lateral sides 60, 62 of the scrub strip 40. The aperture areas 56, 58 are adapted to receive respective extensions 42, 44 of the actuation yoke 30. The cover portion 54 includes a pair of resilient catch members 64, 66 for engaging with and locking into respective slots 68, 70 in the second side 51 of the base portion 48. In addition, the cover portion 54 includes a pair of alignment tabs 72, 74 for engaging with slots 76, 78 of the base portion 48.

Referring to FIGS. 2–5, the scrub strip 40 is movable between a non-use position (FIGS. 2 and 4) wherein the scrub strip 40 is located at a level above the mop head 14, and an operable position wherein the scrub strip 40 is located below lateral edges 80, 82 of the presser plates 18, 20 (FIGS. 3 and 5).

Figure 4:
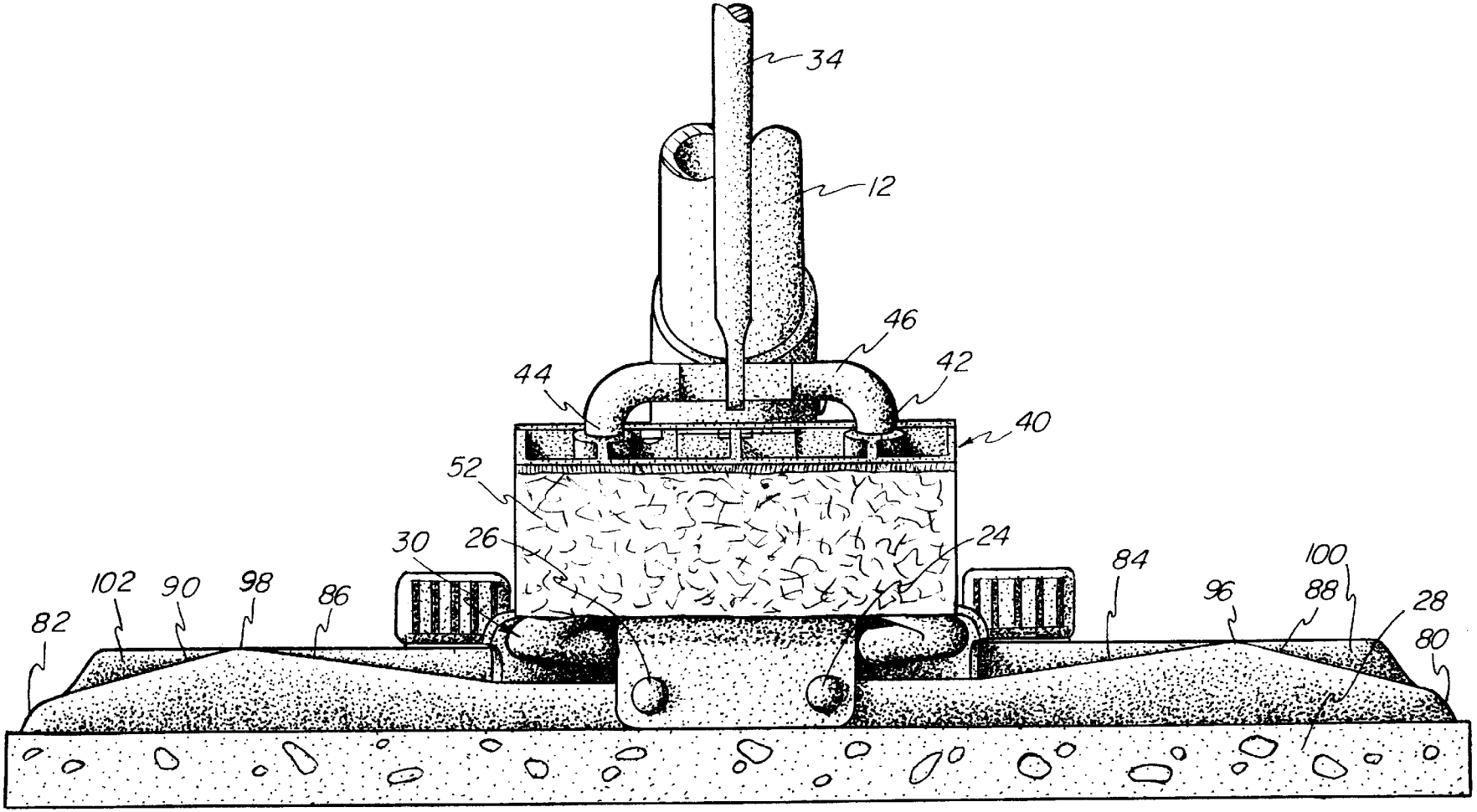
FIG. 4 is a rear elevational view showing the scrub strip in a non-use position.

Referring to FIGS. 1, 4 and 5, the upper surfaces of the presser plates 18, 20 include respective first squeeze arm engaging portions 84, 86 and second squeeze arm engaging portions 88, 90 wherein the first and second squeeze arm engaging portions 84, 86, 88, 90 are located adjacent to back edges 92, 94 of the presser plates 18, 20. The first squeeze arm engaging portions 84, 86 define ramps extending upwardly in a direction from respective pivot points 24, 26 outwardly toward respective lateral edges 80, 82. The second squeeze arm engaging portions 88, 90 define downwardly extending ramps extending from junctions 96, 98 with outer ends of the first squeeze arm engaging portions 84, 86 toward respective lateral edges 80, 82. In addition, stop portions 100, 102 extend upwardly from the second squeeze arm engaging portions 88, 90 in spaced relation to the back edges 92, 94.

The stop portions 100, 102 limit movement of the respective squeeze arms 36, 38 along the second squeeze arm engaging portions 88, 90, and the junctions 96, 98 between the first squeeze arm engaging portions 84, 86 and second squeeze arm engaging portions 88, 90 form over-center surfaces for maintaining the presser plates 18, 20 in the mop pad squeezing position when the slide grip handle 32 is released whereby the scrub strip 40 is maintained in its operable position facing the floor surface below the presser plates 18, 20. Thus, the scrub strip 40 may be conveniently used and held in position when the presser plates 18, 20 are moved together to wring the mop pad 28.

Accordingly, the present invention provides a scrub strip for a butterfly mop which may be conveniently used without requiring reorientation of the mop handle 12 in order to position the scrub strip 40 in a use position. Further, the present invention also provides a mechanism whereby the scrub strip is conveniently held in its operable or use position to facilitate use of the scrub strip during wringing of the mop. In addition, a convenient snap-on structure is provided for the scrub strip whereby the scrub strip is easily positioned on the actuation yoke for the mop, and may be detached and replaced with a new scrub strip if necessary.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mop comprising:

an elongated mop handle;

a slide grip handle slidably received on said mop handle;

an actuation yoke pivotable about a pivot axis;

a connecting link extending between said slide grip handle and said actuation yoke such that movement of said slide grip handle along said mop handle causes said actuation yoke to pivot about said pivot axis;

two presser plates mounted to respective pivot points adjacent an end of said mop handle;

a mop pad mounted to said presser plates;

a pair of squeeze arms defined by said actuation yoke for engaging and pivoting said presser plates toward each other to a mop pad squeezing position when said slide grip handle is moved along said mop handle;

a scrub strip located adjacent ends of said squeeze arms and supported for movement with said actuation yoke between a non-use position and an operable position;

wherein movement of said scrub strip from said non-use position to said operable position coincides with said pivoting of said presser plates toward each other.

2. The mop of claim 1 wherein said presser plates include back edges and lateral edges extending forwardly from said back edges, and said lateral edges face downwardly, away from said mop handle, when said presser plates are pivoted toward each other.

3. The mop of claim 2 wherein said scrub strip is located below said lateral edges when in said operable position whereby said scrub strip is positioned for scrubbing a floor surface.

4. The mop of claim 2 wherein each of said presser plates include first and second squeeze arm engaging portions, said first squeeze arm engaging portion defining an upwardly extending ramp in a direction from a respective pivot point toward a respective lateral edge, and said second squeeze arm engaging portion defining a downwardly extending ramp extending from a junction with an end of said first squeeze arm engaging portion toward said respective lateral edge.

5. The mop of claim 4 including a stop portion extending upwardly from said second squeeze arm engaging portion and located in spaced relation to said back edge wherein said stop portion limits movement of a respective squeeze arm along said second squeeze arm engaging portion, and said junction between said first and second squeeze arm engaging portions forms an overcenter surface for maintaining said presser plates in said mop pad squeezing position when said slide grip handle is released.

6. The mop of claim 1 wherein said actuation yoke includes a transverse portion extending between said squeeze arms and connected to an end of said connecting link, and scrub strip mounting extensions extending from said ends of said squeeze arms to said transverse portion wherein said said scrub strip is supported on said scrub strip mounting extensions.

7. The mop of claim 6 wherein said scrub strip mounting extensions extend from said squeeze arms at an angle directed toward said mop handle, and said scrub strip extends rearwardly from said scrub strip mounting extensions.

8. The mop of claim 1 wherein said scrub strip includes a base portion, a strip of floor scrubbing material attached to a first side of said base portion, and a cover portion attached to a second, opposite side of said base portion, said base portion and said cover portion surrounding a portion of said actuation yoke to retain said scrub strip in position on said actuation yoke.

9. A mop comprising:

an elongated mop handle;

a grip handle supported for movement relative to said mop handle;

a mop pad mounting structure comprising two presser plates mounted to respective pivot points adjacent an end of said mop handle;

a mop pad mounted to said mop pad mounting structure;

an actuation member movably connected to said grip handle and movable relative to said mop pad mounting structure and said mop handle to wring said mop pad in response to movement of said grip handle;

a scrub strip mounted to said actuation member for movement with said actuation member between a non-use position and an operable position;

wherein movement of said scrub strip from said non-use position to said operable position coincides with movement of said actuation member to wring said mop pad.

10. The mop of claim 9 wherein said actuation member comprises an actuation yoke having a pair of squeeze arms for engaging said mop pad mounting structure.

11. The mop of claim 10 wherein said actuation member further comprises a connecting link extending between said grip handle and said actuation yoke.

12. The mop of claim 9 wherein said grip handle comprises a slide grip handle supported for sliding movement on said mop handle.

13. The mop of claim 9 wherein said scrub strip includes a base portion, a strip of floor scrubbing material attached to a first side of said base portion, and a cover portion attached to a second, opposite side of said base portion, said actuation member extending between said base portion and said cover portion whereby said scrub strip is retained on said actuation member.

14. A mop scrub strip in combination with a mop having presser plates mounting a mop pad, and an actuation yoke for moving the presser plates toward each other in a mop wringing operation, said scrub strip comprising:

a base portion having a first side, a second side and opposing lateral sides;

a strip of floor scrubbing material attached to said first side of said base portion;

a cover portion attached to said second side of said base portion; and a passage comprising a pair of apertures defined between said base portion and said cover portion and extending generally parallel to said lateral sides for receiving the actuation yoke of a mop therethrough to thereby support said scrub strip on a mop.

15. The mop scrub strip of claim 14 wherein said cover portion is detachably attached to said base portion.

16. The mop scrub strip of claim 14 wherein said cover portion extends from one lateral side of said base portion to the opposing lateral side.

* * * * *